US010777955B2

(12) United States Patent
Kraus et al.

(10) Patent No.: US 10,777,955 B2
(45) Date of Patent: Sep. 15, 2020

(54) ADJUSTABLE CABLE KINK PROTECTION AND CABLES HAVING THIS KINK PROTECTION

(71) Applicant: Zellner GmbH, Teisnach (DE)

(72) Inventors: Josef Kraus, Blossersberg (DE); Joachim Zellner, Rinchnach (DE); Ernst Klees, München (DE)

(73) Assignee: Zellner GmbH, Teisnach (DE)

( * ) Notice: Subject to any disclaimer, the term of this patent is extended or adjusted under 35 U.S.C. 154(b) by 0 days.

(21) Appl. No.: 16/486,332

(22) PCT Filed: Feb. 1, 2018

(86) PCT No.: PCT/EP2018/052567
§ 371 (c)(1),
(2) Date: Aug. 15, 2019

(87) PCT Pub. No.: WO2018/149657
PCT Pub. Date: Aug. 23, 2018

(65) Prior Publication Data

US 2020/0203904 A1 Jun. 25, 2020

(30) Foreign Application Priority Data

Feb. 15, 2017 (DE) ..... 10 2017 102 995

(51) Int. Cl.
*H01R 24/64* (2011.01)
*H01R 13/506* (2006.01)
(Continued)

(52) U.S. Cl.
CPC ..... *H01R 24/64* (2013.01); *H01R 13/506* (2013.01); *H01R 13/562* (2013.01); *H01R 13/5841* (2013.01); *H01R 13/627* (2013.01)

(58) Field of Classification Search
CPC ..... H01R 13/5841; H01R 13/5812; H01R 35/04; H01R 13/562; H01R 13/567;
(Continued)

(56) References Cited

U.S. PATENT DOCUMENTS 5,692,921 A * 12/1997 Jennings ..... H01R 13/20 439/173
5,772,447 A * 6/1998 Cheung ..... H01R 24/28 439/31

(Continued)

*Primary Examiner* — Edwin A. Leon
*Assistant Examiner* — Matthew T Dzierzynski
(74) *Attorney, Agent, or Firm* — Mark M. Friedman

(57) ABSTRACT

The invention refers to a kink protection for prefabricated cables having first and second sleeves which fit around part of the cable or a plug connector adapted to be assembled in different relative positions. Each of the two sleeves is designed in general as a rectilinear tube section with a longitudinal axis. One end of the first sleeve has two integrally formed projections in the form of two regular octagons having the same spanner width, which are arranged on both sides of the longitudinal axis and the rotational axes of symmetry of which coincide and perpendicularly intersect the longitudinal axis. One end of the second sleeve has four elongated extensions which are distributed in a rotationally symmetrical manner about the longitudinal axis, each extending parallel to the longitudinal axis. Two mutually adjacent extensions form a spanner jaw having a jaw width corresponding to the spanner width of the octagon.

14 Claims, 7 Drawing Sheets

(51) Int. Cl.
*H01R 13/627* (2006.01)
*H01R 13/56* (2006.01)
*H01R 13/58* (2006.01)

(58) Field of Classification Search
CPC ..... H01R 24/64; H01R 13/506; H01R 13/58; H01R 13/5804; H01R 13/5825; H01R 13/5829
See application file for complete search history.

(56) References Cited

U.S. PATENT DOCUMENTS

| | | | | |
|---|---|---|---|---|
| 6,419,519 | B1 * | 7/2002 | Young | H01R 13/5812 439/446 |
| 6,638,076 | B2 * | 10/2003 | Wang | H01R 13/6205 439/39 |
| 7,131,858 | B1 * | 11/2006 | Zerebilov | H01R 9/0518 439/446 |
| 7,837,495 | B2 * | 11/2010 | Baldwin | H01R 13/5804 439/446 |
| 7,862,369 | B2 * | 1/2011 | Gimenes | H01R 13/5812 439/446 |
| 9,118,158 | B2 * | 8/2015 | Kern | H01R 43/00 |
| 9,276,354 | B2 * | 3/2016 | Kraus | H01R 13/6272 |
| 9,413,116 | B1 * | 8/2016 | Villasenor | H01R 13/5812 |
| 9,537,279 | B2 * | 1/2017 | Penumatcha | H01R 43/26 |
| 9,627,800 | B2 * | 4/2017 | Taylor | H01R 13/5841 |
| 10,135,181 | B2 * | 11/2018 | Droesbeke | G02B 6/3865 |
| 2020/0076121 | A1 * | 3/2020 | Zellner | H01R 13/5825 |

* cited by examiner

ADJUSTABLE CABLE KINK PROTECTION AND CABLES HAVING THIS KINK PROTECTION

The invention relates to a kink protection for prefabricated cables, i.e. for cables having at least one plug connector at one end, the kink protection containing a first and a second sleeve each of which fits around part of the cable and/or of a plug connector of the same and is adapted to be assembled in different relative positions; as well as to a data cable or signaling cable having such a kink protection.

A cable kink protection is a straight or angled protective sleeve which surrounds part of a plug connector and of the cable connected to it so as to protect this area, which is subjected to great strain, from kinking or tearing, and which predefines the direction of the outgoing cable.

Cable kink protections with variable angular positions are known as well which allow more effective cable routing which is easier to monitor, e.g. on patch panels.

Thus, DE 20 2014 010 869 U1 discloses a kink protection having the features of the preamble of claim 1. In one embodiment, the two sleeves are provided with octagonal structures which allow placing the angled sleeve which is distal to the plug around the longitudinal axis of the sleeve proximal to the plug and of the plug connector in eight defined positions which are spaced by 45°. In addition, the distal sleeve is angled transversely to the longitudinal axis, where this angle is to a certain degree continuously variable. This kink protection, however, has a complex structure, and a selected angle at which the cable exits from the kink protection with reference to the longitudinal axis, can easily change during handling of the patch panel.

US 2009 0111 319 A1 discloses a kink protection with strain relief for assembly in a plug, where the orientation of the sleeve with respect to the plug for cable routing can be set definitely. Construction and assembly, however, are complex.

US 2015 0071 590 A1 discloses a plug with strain relief and rotatable kink protection on the plug, the kink protection being formed by a relatively stiff part at the cable outlet of the plug, which can lockingly rotate about a rotational axis integrally connected to the plug, and which can assume different angular positions with respect to the plug, depending on the direction in which the cable is pulled. For many applications, the setting of a defined angle is not stable enough. The device components of the revolute joint break easily; taken as a whole, the strain relief is complex.

US 2015 0064 961 A1 discloses a plug having a fixed and a pivoting part, where the pivoting part having a cable outlet is lockingly rotatable about a rotational axis perpendicular to the plug axis, with respect to the fixed part. Locking of the plug in a rotational position takes place by overcoming lugs, which can be achieved by making a clip of the pivoting part elastic. If elasticity of the pivoting part, which normally consists of a plastic, decreases or increases, the part may break or locking becomes less stable. The device is rather suited for smaller tensile and pivoting forces.

DE 3 918 517 C1 discloses a plug connector with a strain relief output piece which is connected and preferably welded to the cable. The strain relief output piece can be plugged onto the plug connector in the longitudinal direction or at an angle of 90° and can be connected to the plug connector by a four-edged transverse pin.

Variable kink protections in the form of elastically deformable cable overmolds are also commercially available which can be continuously angled in any desired direction. However, the desired direction may be unintentionally altered during handling of the patch panel.

The invention is based on the task of providing an adjustable cable kink protection which is structured as simply as possible and where the direction in which the cable leaves the kink protection can be fixed both about the longitudinal axis of the respective plug connector and transversely to it in particularly advantageous configurations.

This task is solved by a kink protection having the features of claim 1. Advantageous further developments of the invention are indicated in the dependent Claims.

According to the invention, each of the two sleeves is generally designed simply as a short rectilinear tube section with a central longitudinal axis.

One end of the first sleeve has two integrally formed projections in the form of two regular octagons having the same spanner width, which are arranged on both sides of the longitudinal axis of the first sleeve spaced in a rotationally symmetrical or mirrored manner, that is, spaced by 180°, the central axes or rotational axes of symmetry of the octagons coinciding with each other and perpendicularly intersecting the longitudinal axis of the first sleeve.

One end of the second sleeve has four integrally formed, elongate extensions which are distributed in a rotationally symmetrical manner—that is, in increments of 90°—about the longitudinal axis of the second sleeve and each of which extends parallel to the longitudinal axis of the second sleeve away from the second sleeve, but preferably not farther than the spanner width of the octagons. In each case, two mutually adjacent extensions form a spanner jaw having a jaw width corresponding to the spanner width of the octagon and preferably also having a corresponding jaw shape.

Depending on the relative position in which the mutually aligned octagons of one sleeve are engaged in the mutually aligned spanner jaws of the other sleeve, the second sleeve can be coupled with the first sleeve in two angular positions spaced by 90° about its longitudinal axis and also in five angular positions spaced by 45° in the direction of its longitudinal axis and will then be stably kept in the selected position by the spanner jaws. The number of fixed configurations or relative positions which can be achieved in this manner is necessary but also sufficient for obtaining a highly organized patch panel.

In a preferred embodiment, the first sleeve is the one fitting around part of the cable and the second sleeve is the one fitting around the cable and around part of a plug connector of the same; but the roles could also be reversed.

The kink protection according to the invention can have a relatively simple structure and can therefore be easy to manufacture. Thus, the first sleeve can have a generally circular cross-section, except for, among others, the octagons or any grip structures and ribbings which may be present, and the second sleeve can have a generally rectangular cross-section, except for e.g. the extensions or spanner jaws and maybe a snap-in pin protection for a snap-in pin on the plug.

Preferably, the free ends of the four extensions are each provided with two integral lugs each of which protrudes in the direction facing the adjacent extension so as to lock the octagons inserted in the spanner jaws into place. Also, the octagons are preferably oriented such that two edges of each extend in parallel to the longitudinal axis of the first sleeve.

In the case of the lugs, a certain material elasticity is necessary for the spanner jaws to be able to lock into place in the octagons. This is easy to achieve if the sleeves are one-piece injection molded plastic parts, as is preferable anyway, optionally having metal coatings or inserts for electromagnetic shielding.

In the embodiments mentioned above, the kink protection consists of only two parts which are additionally easy to manufacture.

In a preferred further development, one or preferably two closure caps are additionally supplied together with the kink protection, which can lock into and close free spanner jaws which are not occupied by the octagons of the one sleeve, each closure cap generally having the shape of the octagon of the first sleeve, at least as far as is visible in the assembled state. Depending on the angular setting of the kink protection, one or two closure caps can be attached to it in order to provide a more aesthetic appearance to the kink protection. In addition, the closure caps can help to reversibly fix the selected relative position of the two sleeves into place.

The plug connectors are normally male parts, i.e. plugs, but they can also be female components, i.e. sockets or couplings. A transition area between the cable and the plug connector has preferably an overmold which positively engages the second sleeve. The kink protection is preferably a data cable or signaling cable kink protection, even more preferably a patch cable or network cable kink protection, even more preferably for RJ plugs.

In the following, an example of embodiment will be explained by means of the drawings wherein FIG. 1 shows one end of a patch cable with adjustable kink protection in a first basic configuration in a perspective view, different planar views and a perspective exploded view;

Figure 1:
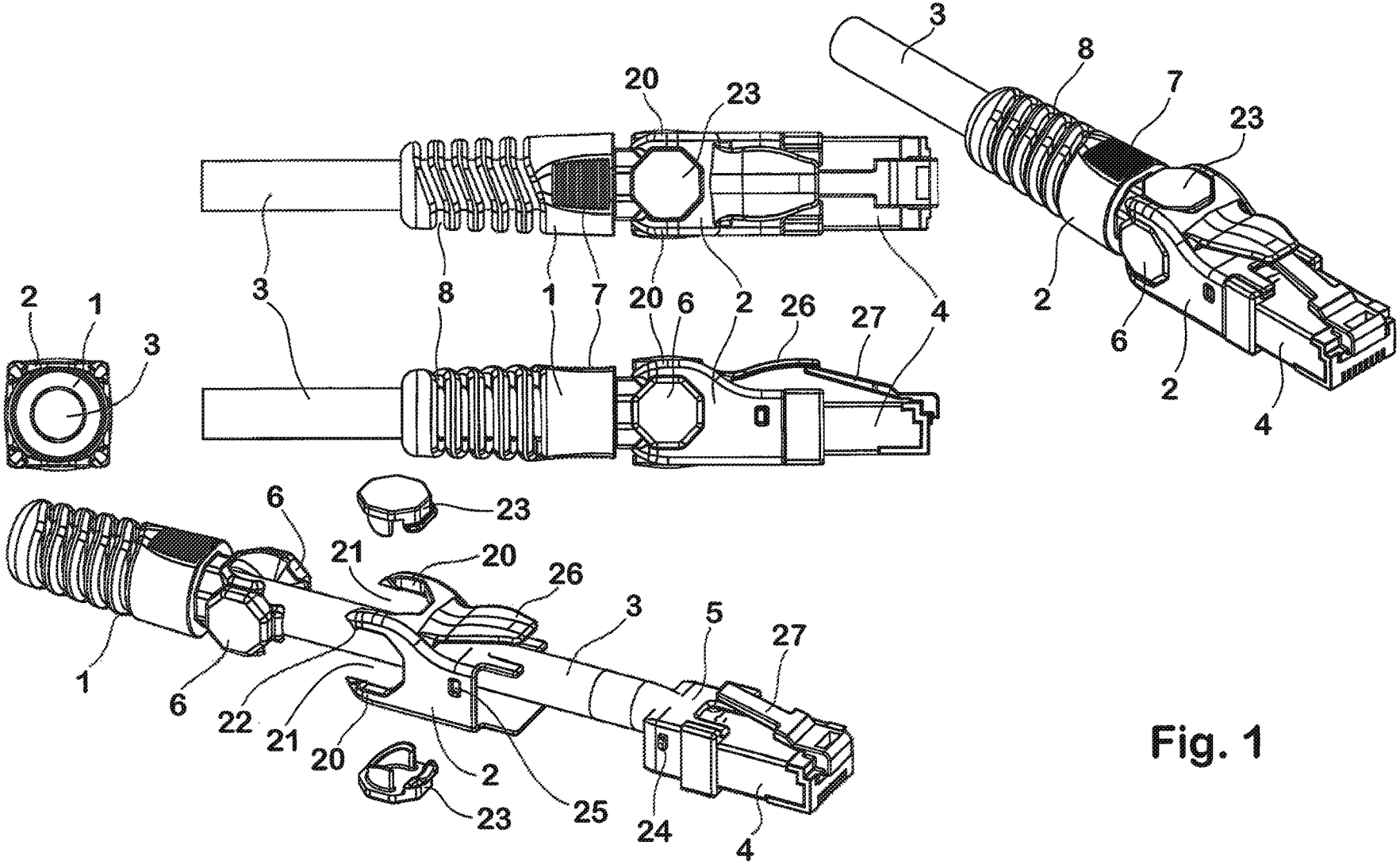

The figures show a kink protection with two main components injection-molded from plastic, namely a first sleeve 1 and a second sleeve 2 which fit on a cable 3. After the sleeves 1 and 2 have been slid onto the cable 3 (or also before that, if the other cable end has not yet been fabricated), the cable 3 is provided with an RJ45 plug 4 (in the following also called plug connector) at the indicated end. By means of the closure caps 23, the set output angle can be further stabilized, if necessary.

In the example of embodiment, a transition area between the cable 3 and the plug 4 is additionally provided with an overmold 5 which both stabilizes this area and forms an intermediary for positive engagement with the second sleeve 2 when the second sleeve 2 is slid onto the plug 4 from the rear. The overmold 5 can be left out, however, if the second sleeve 2 itself fits well on the plug 4.

Each of the two sleeves 1 and 2 is generally designed as a rectilinear tube section with a central longitudinal axis, the first sleeve 1 generally having a round cross-section and the second sleeve 2 generally having a rectangular cross-section. Other cross-sections of the sleeves are possible provided that they fit on the cable and/or on the respective plug (4).

On one end of the first sleeve 1, which is to be coupled with the second sleeve 2, two projections in the form of two regular octagons 6 having the same spanner width are integrally formed. As can be seen in the figures, the octagons are arranged in a rotationally symmetrical manner, or mirrored, on both sides of the longitudinal axis of the first sleeve 1. The central axes or rotational axes of symmetry of the two octagons 6 coincide and perpendicularly intersect the longitudinal axis of the first sleeve 1. In addition, two edges of each octagon 6 extend parallel to the longitudinal axis of the first sleeve 1.

The first sleeve 1 in addition has grip ribbings 7 and grooves 8 which provide flexibility to the end of the first sleeve 1 which faces away from the octagons 6.

The second sleeve 2 fits, with one end, on the plug 4 with the overmold 5 and expands in the direction facing its other end which is to be coupled with the first sleeve 1, from a rectangular cross-section to an increasingly square-shaped cross-section.

The area with increasingly square-shaped cross-section is defined by four elongated extensions 20 which are formed integrally at a plug-end part of the second sleeve 2 and which are distributed in a generally rotationally symmetrical manner, that is, in square shape, about the longitudinal axis of the second sleeve 2, each extension 20 extending parallel to the longitudinal axis of the second sleeve 2 in the direction facing the first sleeve 1.

In each case two mutually adjacent extensions 20 of the second sleeve 2 form between themselves a spanner jaw 21 having a jaw width and jaw shape which correspond to the spanner width and circumferential shape of the octagons 6 of the first sleeve 1.

On each free end of the four extensions 20, two lugs 22 are formed which protrude towards the adjacent extensions 20. Together with the lugs 22, the length of the extensions 20 is approximately as large as the spanner width of the octagons 6.

The edge length of the square within which the extensions 20 are generally arranged is substantially defined by the width of the plug 4 and is slightly larger than the latter, and the spanner width of the spanner jaws 21 formed between them is made sufficiently smaller than the edge length of the abovementioned square so that during use the extensions 20 do not break off, but also have a certain elasticity.

In the example mentioned above, the jaw width of the spanner jaws 21 formed between the extensions 20 and the spanner width of the octagons 6 amount to approximately three quarters of the edge length of the abovementioned square. In the example shown, this edge length is also identical to the distance of the outer faces of the two octagons 6 on the first sleeve 1 so that the outer faces of the octagons 6 are aligned with the outer faces of the extensions 20 when the sleeves 1 and 2 are connected. However, the octagons 6 may also more or less protrude from the second sleeve 2 without impairing the functioning of the kink protection.

In addition to the two sleeves 1 and 2, two additional components made of injection-molded plastic, having the form of closure caps 23, whose visible surfaces are formed like the octagons 6 on the first sleeve 1, are also part of the disclosed kink protection. The closure caps 23 are arrested in those spanner jaws 21 which remain free between two extensions after the two sleeves 1 and 2 have been connected, and providing a coherent aesthetic appearance to the assembled kink protection. In addition, the closure caps 23 reversibly arrest the defined cable output angle.

On the bottom left of FIG. 1, the sleeves 1 and 2 are slid onto the cable 3 in succession, with the first sleeve 1 being oriented such that the common central axis of the octagons 6 extends in parallel to the width direction of the plug 4. For further assembly, first the second sleeve 2 is slid onto the plug 4, with small protrusions 24 on the overmold 5 of the plug 4 being arrested in matching recesses 25 in the second sleeve 2. In addition, during this process, a snap-in pin protection 26 formed on the second sleeve 2 is slid over a snap-in pin 27 on the plug 4.

Next, the first sleeve 1 is moved straight towards the second sleeve 2, with each of the two octagons 6 being inserted between two of the extensions 20. Due to the presence of the lugs 22, the extensions 20 are bent a little outward during this process and snap back together as soon as the lugs 22 can enclose the octagons 6. This is the first basic configuration which is shown in the other views in FIG. 1 and in which the cable 3 exits the plug 4 in a substantially straight line.

Figure 2:
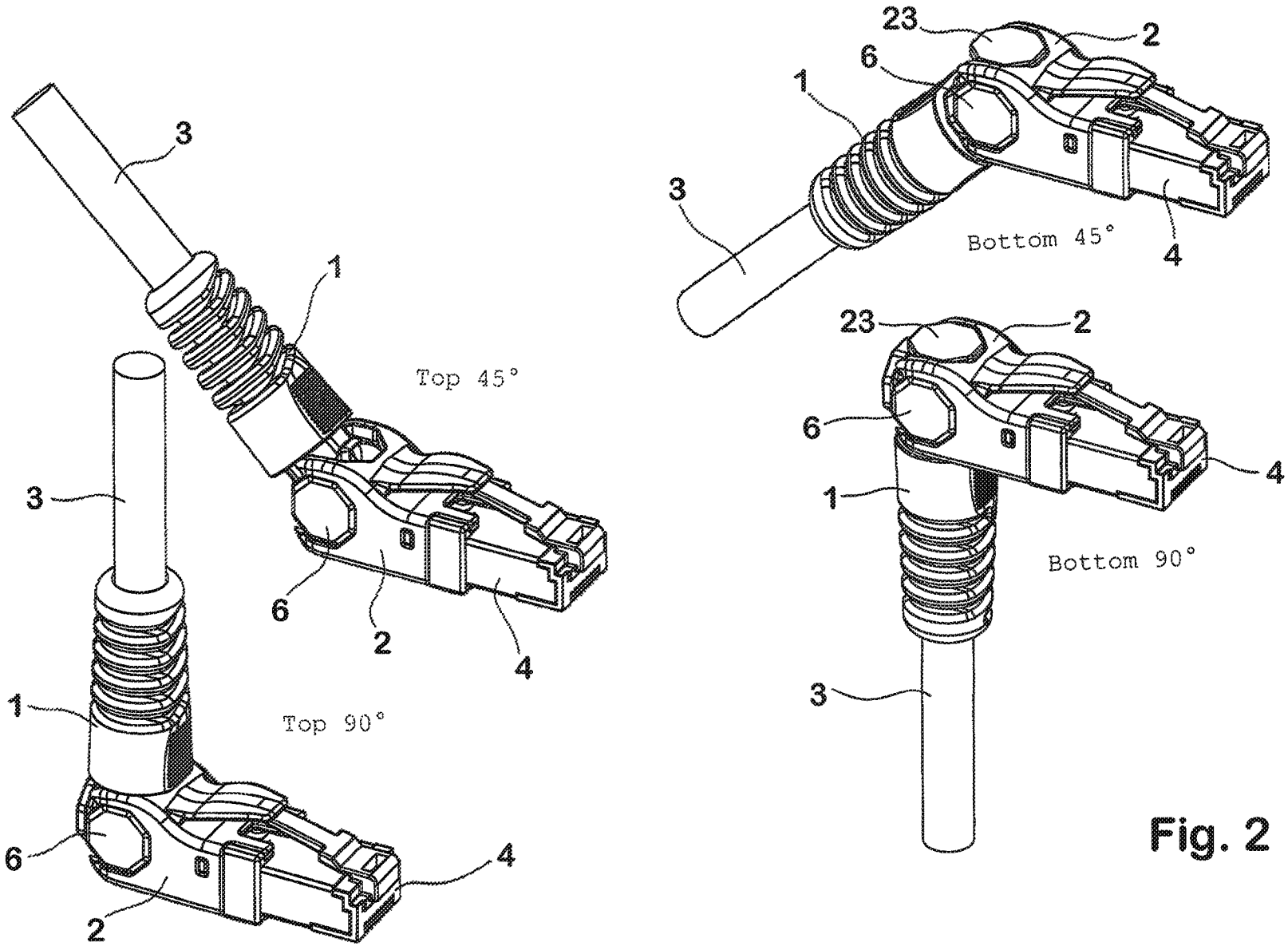
FIG. 2 shows four variants of the first basic configuration in perspective views.

Four possible variants of the first basic configuration are shown in FIG. 2. These variants consist in holding the first sleeve 1, in a state separated from the second sleeve 2, at an upward or downward angle of 45° or 90° with respect to the longitudinal axis of the second sleeve 2 and sliding it over the cable 3 while maintaining this angle, until the two octagons 6 are completely arrested in the respective spanner jaws 21.

In these variants, therefore, the cable 3 exits the plug 4 at an upward or downward angle of 45° or 90°, with the respective plane of reference in FIG. 2 being horizontal, that is, parallel to the width direction of the plug 4. In these cases as well, free spanner jaws 21 can be closed by closure caps 23; in the 45° positions, however, only one closure cap 23 each can be mounted, as can be seen in FIG. 2.

Figure 3:
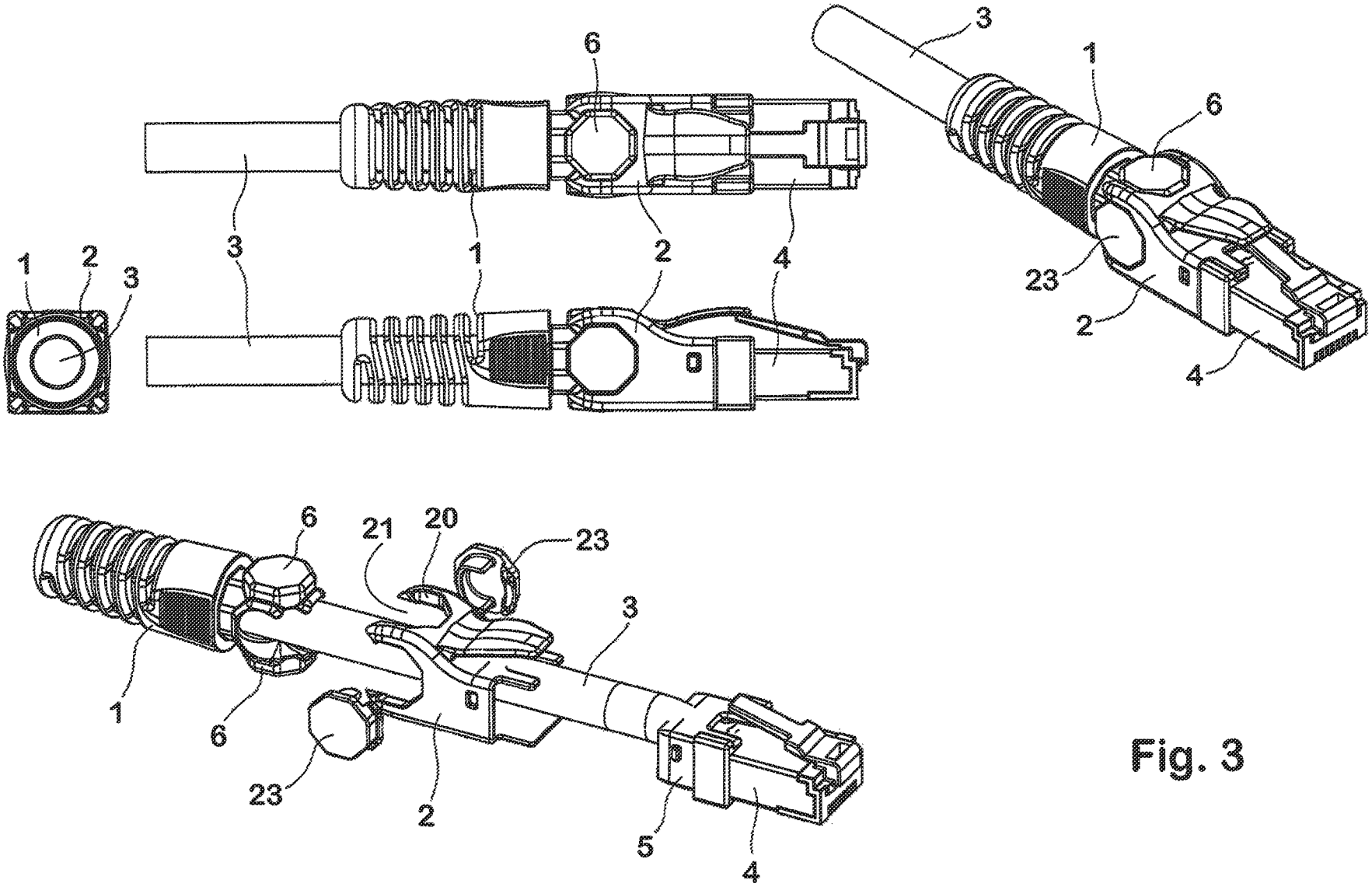
FIG. 3 shows the patch cable of FIG. 1 in a second basic configuration in a perspective view, different planar views and a perspective exploded view.

FIG. 3 shows the patch cable of FIG. 1 in a second basic configuration which differs from the first basic configuration in FIG. 1 only in that the first sleeve 1 is oriented such that the common center axis of the octagons 6 does not extend in parallel to the width direction, as in FIGS. 1 and 2, but in parallel to the height direction of the plug 4. Assembly is performed accordingly. In the second basic configuration as well, the cable 3 exits the plug 4 in a substantially straight line.

Figure 4:
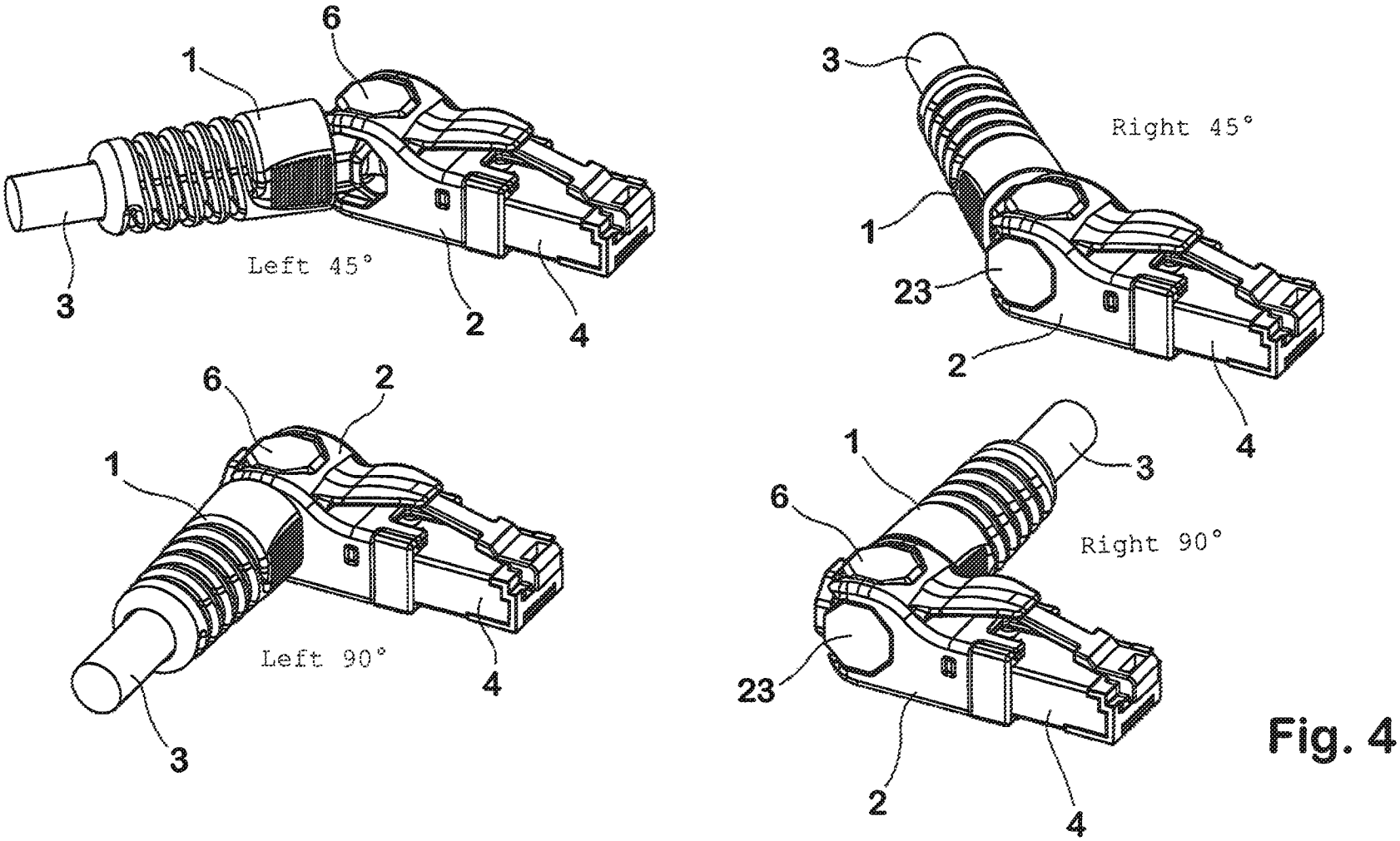
FIG. 4 shows four variants of the second basic configuration in perspective views.

Four possible variants of the second basic configuration are shown in FIG. 4. These variants consist in holding the first sleeve 1 at an angle of 45° or 90° to the right or to the left with respect to the longitudinal axis of the second sleeve 2 and sliding it over the cable 3 while maintaining this angle, until the two octagons 6 are completely arrested in the respective spanner jaws 21.

In these variants, the cable 3 thus exits the plug 4 at an angle of 45° or 90° to the left or to the right, with the respective level of reference in FIG. 4 extending vertically, i.e. in parallel to the height direction of the plug 4. Here as well, one or two free spanner jaws 21 can be closed by one or two closure caps 23.

Figure 5:
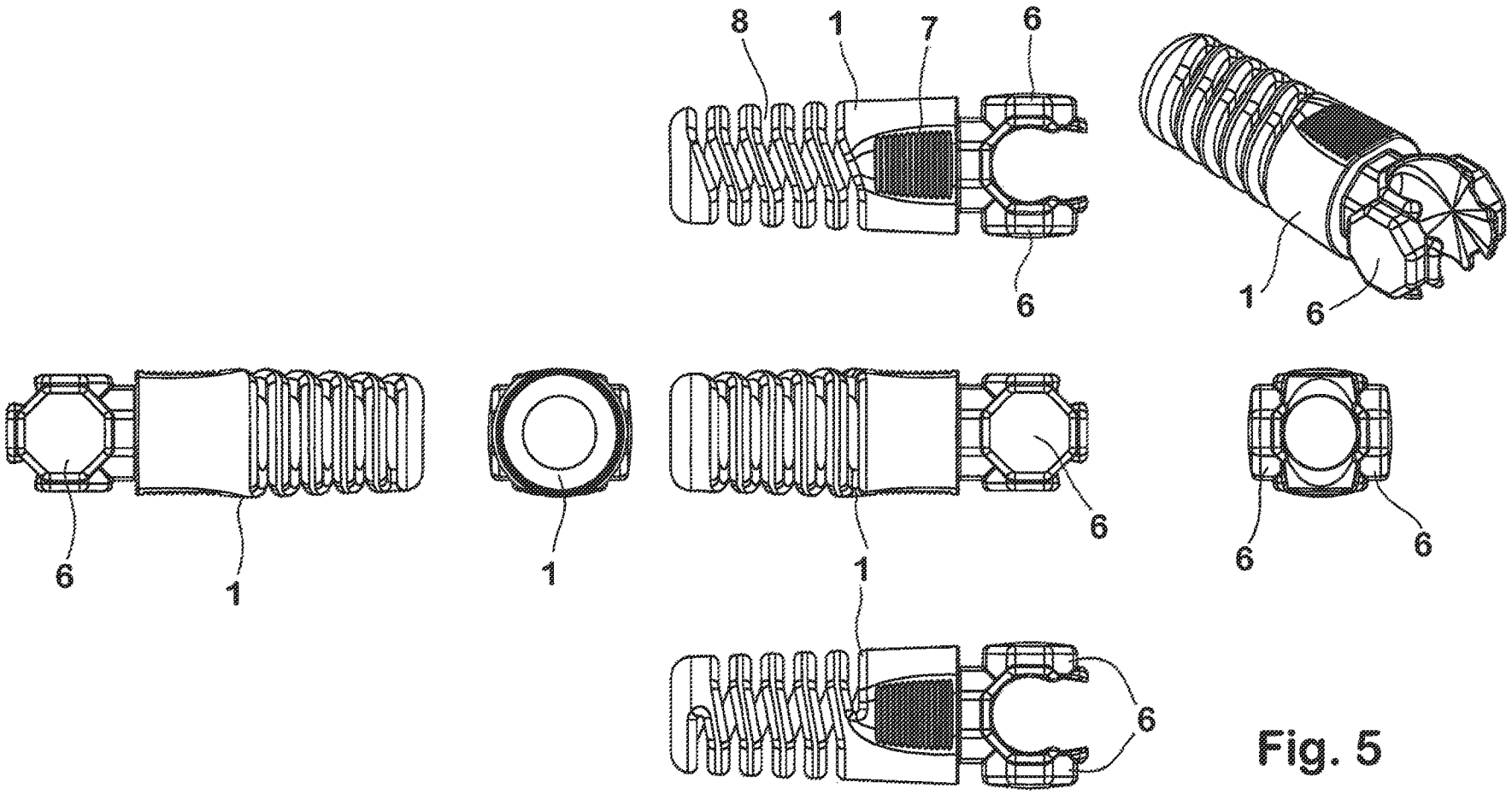
FIG. 5 shows the first sleeve of the kink protection in a perspective view and in planar views, enlarged and from all directions.
Figure 6:
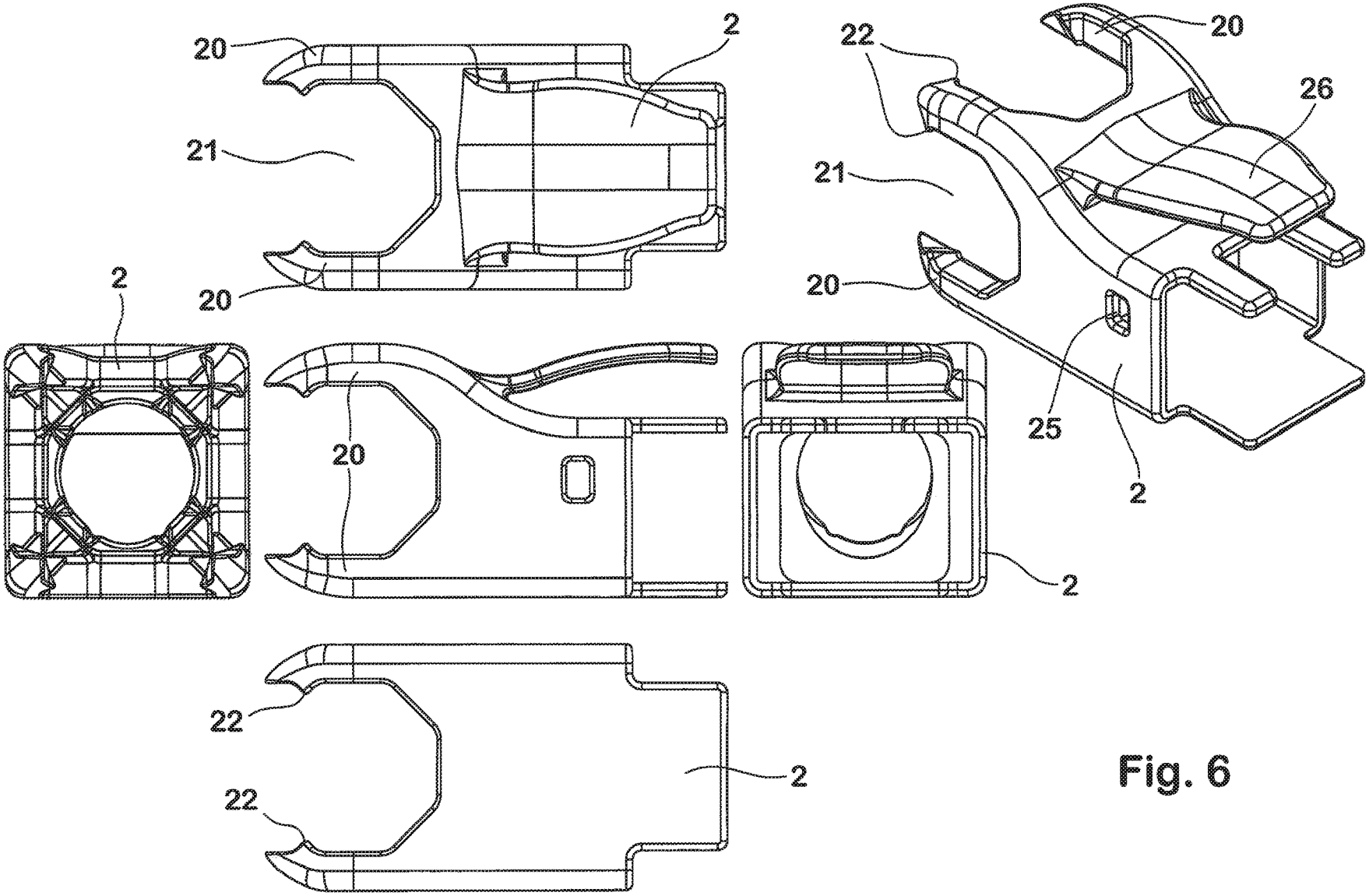
FIG. 6 shows the second sleeve of the kink protection in a perspective view and in planar views, enlarged and from all directions.
Figure 7:
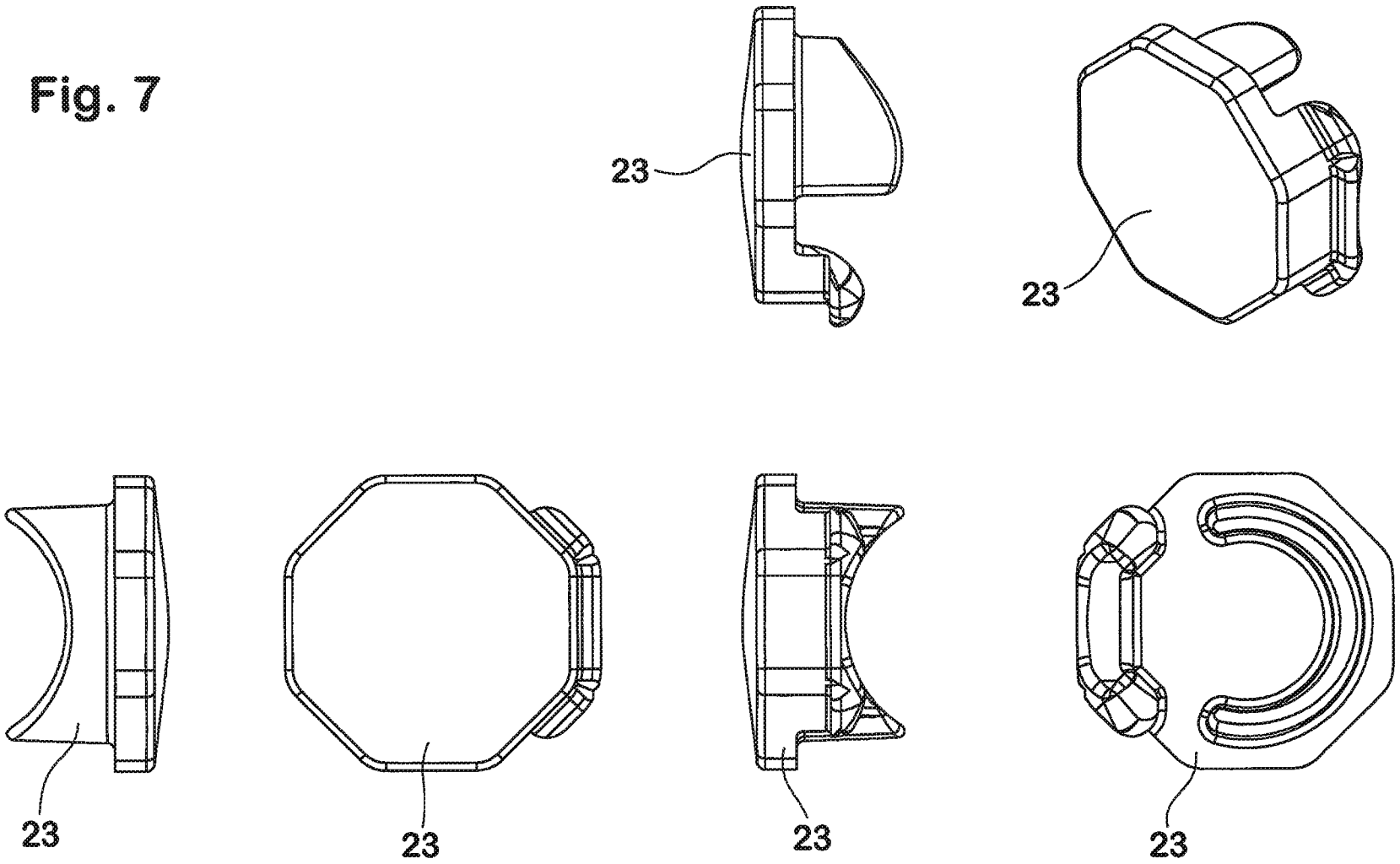
FIG. 7 shows a closure cap for the kink protection in a perspective view and in planar views, enlarged and from all directions.

The first sleeve 1, the second sleeve 2 and one of the closure caps 23 are shown in more detail in FIGS. 5 through 7, with the same reference numbers as in FIGS. 1 through 5 being used to indicate the same parts. For the descriptions of FIGS. 5 through 7, therefore please refer to the specification for FIGS. 1 through 5.

Other possible embodiments are described in the following Claims. In particular, the various features of the embodiments described above can be combined provided that they are not mutually exclusive from a technical point of view.

Furthermore, although in the above embodiments of the invention the extensions are formed on the sleeve connected to the plug and the projections are formed on the sleeve slid onto the cable, a reversal of this construction is conceivable. In this embodiment, the extensions would be provided on the sleeve slid onto the cable and the projections on the sleeve connected to the plug.

In addition, it would also be conceivable according to the invention to provide the projections or the extension with a different geometrical shape, such as a hexagon, provided that the extension and the projection could be engaged with each other and arrested in a specific geometrical position.

The reference numbers given in the Claims are only for better comprehensibility and do not in any way limit the Claims to the forms shown in the Figures.

The invention claimed is:

1. Kink protection for prefabricated cables, the kink protection containing a first and a second sleeve which each fit around part of the cable and/or of a plug connector of the same and are adapted to be assembled in different relative positions, wherein each of the two sleeves is designed in general as a rectilinear tube section with a central longitudinal axis, where one end of the first sleeve has two integrally formed projections in the form of two regular octagons having the same spanner width, which are arranged on both sides of the longitudinal axis of the first sleeve and the rotational axes of symmetry of which coincide and perpendicularly intersect the longitudinal axis of the first sleeve, and where one end of the second sleeve has four integrally formed, elongated extensions which are distributed in a rotationally symmetrical manner about the longitudinal axis of the second sleeve and which each extend parallel to the longitudinal axis of the second sleeve, wherein in each case two mutually adjacent extensions form a spanner jaw having a jaw width corresponding to the spanner width of the octagon.

2. Kink protection according to claim 1, the first sleeve is the one fitting around part of the cable and the second sleeve is the one fitting around the cable and part of a plug connector of the same.

3. Kink protection according to claim 2, wherein the first sleeve generally has a round cross-section and the second sleeve generally has a rectangular cross-section.

4. Kink protection according to claim 1, wherein the octagons are oriented such that two of the edges of each extend in parallel to the longitudinal axis of the first sleeve.

5. Kink protection according to claim 1, wherein each of the free ends of the four extensions has two integrally formed lugs protruding in the direction of the adjacent extensions.

6. Kink protection according to claim 1, wherein the sleeves are one-piece injection molded plastic parts, or wherein the sleeves are one-piece injection molded plastic parts and have metallic coatings or inserts for electromagnetic shielding.

7. Kink protection according to claim 1, wherein one or two closure caps for engagingly closing free spanner jaws additionally belong to the kink protection, each closure cap generally having the shape of the octagon of the first sleeve.

8. Kink protection according to claim 1, wherein a transition area between the cable and the plug connector has an overmold which positively engages the second sleeve.

9. Kink protection according to claim 1, wherein the kink protection is a data cable or signaling cable kink protection.

10. Kink protection according to claim 1, wherein the closure caps are adapted for additionally arresting the defined relative positions of the first and second sleeves in a reversible manner.

11. A cable which is a data cable or signaling cable or a patch cable or network cable, having a kink protection according to claim 1.

12. A cable according to claim 11, having RJ plugs.

13. Kink protection according to claim 1, wherein the kink protection is a patch cable or network cable kink protection.

14. Kink protection according to claim 1, having a patch cable or network cable kink protection and an RJ plug.

* * * * *